US011116363B2

(12) United States Patent
Bradley

(10) Patent No.: US 11,116,363 B2
(45) Date of Patent: Sep. 14, 2021

(54) DISPENSING SYSTEM

(71) Applicant: Mark Anthony Bradley, Galway (IE)

(72) Inventor: Mark Anthony Bradley, Galway (IE)

( * ) Notice: Subject to any disclaimer, the term of this patent is extended or adjusted under 35 U.S.C. 154(b) by 0 days.

(21) Appl. No.: 16/341,611

(22) PCT Filed: Oct. 13, 2017

(86) PCT No.: PCT/IB2017/001337
§ 371 (c)(1),
(2) Date: Apr. 12, 2019

(87) PCT Pub. No.: WO2018/069762
PCT Pub. Date: Apr. 19, 2018

(65) Prior Publication Data

US 2020/0029748 A1 Jan. 30, 2020

(30) Foreign Application Priority Data

Oct. 14, 2016 (GB) ..... 1617503

(51) Int. Cl.
*A47K 5/12* (2006.01)
*A47K 10/32* (2006.01)

(52) U.S. Cl.
CPC ..... *A47K 5/12* (2013.01); *A47K 2010/3246* (2013.01)

(58) Field of Classification Search
CPC . A47K 5/12; A47K 2010/3246; A47K 5/1202
See application file for complete search history.

(56) References Cited

U.S. PATENT DOCUMENTS 3,018,779 A * 1/1962 Tyler ..... A61M 1/0023 604/181
4,085,867 A 4/1978 Heller
(Continued)

*Primary Examiner* — J C Jacyna
(74) *Attorney, Agent, or Firm* — Brian R. Galvin; Galvin Patent Law LLC

(57) ABSTRACT

The present invention relates to dispensing systems that include containers used to contain fluids that need to be dispensed in controlled quantities. In particular, the present invention relates to a dispensing system which can be readily and securely fastened to the walls and other operating surfaces associated with bathrooms, changing rooms, machine shops and the like. In water closets at places of work, hospitals, laboratories, workshops and similar places, there are many individuals who require access to liquids such as liquid soap, oils and production process chemicals etc. usually have a reservoir that must be filled from a larger supply container. The filling operation tends to be complicated and thus time-consuming and with the likelihood of the creation of a mess. It is often difficult to feed the product directly into the dispenser container by pouring the liquid from a big supply tank. It is important that the fluids—whether for lubricating, cleaning or production processes—are managed such that only the correct fluids are. In the installation of a liquid dispensing system, factors of convenience in ensuring that the dispensers are maintained at a suitable level must be weighed against security of product. Many "universal" systems relinquish security and stock control and/or are complex to utilise. The present invention seeks to provide a solution to the problems addressed above. The present invention seeks to provide a dispensing system and a container that enables simple checking of fluid levels and simple re-filling thereof.

11 Claims, 8 Drawing Sheets

(56) References Cited

U.S. PATENT DOCUMENTS

| | | | | |
|---|---|---|---|---|
| 5,638,989 | A * | 6/1997 | Ophardt | A47K 5/1207 222/105 |
| 2006/0071033 | A1* | 4/2006 | Lewis | A47K 5/1207 222/321.9 |
| 2007/0039976 | A1* | 2/2007 | Saleh | A47K 5/1202 222/608 |
| 2007/0269251 | A1* | 11/2007 | Skalitzky | A45D 34/00 401/2 |
| 2008/0035677 | A1* | 2/2008 | Daansen | B65D 47/2031 222/310 |
| 2010/0301070 | A1* | 12/2010 | Allef | A47K 5/1208 222/207 |
| 2011/0132930 | A1* | 6/2011 | Haworth | A47K 5/12 222/135 |
| 2011/0259920 | A1 | 10/2011 | Rennie et al. | |
| 2014/0209638 | A1* | 7/2014 | Ciavarella | A47K 5/16 222/190 |
| 2015/0336719 | A1* | 11/2015 | Bradley | B65D 47/06 220/212 |

* cited by examiner

DISPENSING SYSTEM

CROSS-REFERENCE TO RELATED APPLICATIONS

| Application No. | Date Filed | Title |
|---|---|---|
| Current application | Herewith | Dispensing System |
| | | Is a National Phase Entry (371) filing of: |
| PCT/IB2017/001337 | Oct. 12, 2017 | Dispensing System With Securement |
| | | which is a PCT filing of Great Britain application: |
| GB1617503.6 | Oct. 14, 2016 | Dispensing System |

the entire specification of each of which are incorporated herein by reference.

BACKGROUND

Field of Invention

The present invention relates to dispensing systems that include containers used to contain fluids that need to be dispensed in controlled quantities. In particular, the present invention relates to a dispensing system which can be readily and securely fastened to the walls and other operating surfaces associated with manufacturing facilities, machine shops, bathrooms, changing rooms and the like.

Background to the Invention

In water closets at places of work, hospitals, laboratories, and similar places, there are many individuals who require access to cleaning soap. Providing soap and detergent bars for multiple use poses a problem because some individuals dislike using a soap bar which had been used before by a person who may have left a wet, soggy soap bar. Accordingly, it is preferred that soap and detergents are provided as liquids, since liquid soap is already partially emulsified in a diluent resulting in quick further dispersal. Liquid soap dispensers are well known and have been used and widely installed in lavatories in public places, such as restaurants, schools, hospitals, trains, etc.

In workshops, production facilities and machine shops, liquids such as oils, cutting fluids and the like are required to be present for functional operation. For example, in a machine shop or work shop, a cutting fluid needs to be provided for a lathe, equally, in a production facility, an oil may need to be supplied for a production line process.

Prior art devices for dispensing liquid soap, oils and production process chemicals etc. usually have a reservoir that must be filled from a larger supply container. The filling operation tends to be time-consuming and messy. Such dispensers are usually mounted to a wall, making some parts difficult to service or replace. Also, it is often difficult to feed the product directly into the dispenser container by pouring the liquid from a big supply tank because the dispenser is so close to the wall.

Prior dispensers have typically been of relatively complex construction, frequently using a large number of parts, the assembly of which entails substantial labour. For example, some dispensers employ a complex pressuring system to dispense the liquid, for example, if the liquid is required to be available at several areas within a production facility. These devices result in mechanical difficulties and are subject to undue wear and fairly rapid breakdown. Some difficulties may also arise when screws must be loosened for the replacement of parts, particularly the dispensing nozzle or cartridge pump, which may become rusted nor otherwise corroded following contact with chemicals and/or encrusted with the soap/chemical/emulsified oils. The greater the complexity, the more likely that attempts will be made to bypass the process, raising concerns with health and safety issues and, as an indirect result compromising any ISO certification/accreditation that may exist with a facility.

Such liquid dispensers are typically filled up on a weekly basis, for a water closet environment; at the start of a shift in a production facility. For example, chemicals currently used in the commercial cleaning industry or any industry are typically stored in standard blow moulded containers, for example 5 litre containers. FIG. 1*a* shows a standard type of five litre container. The container is blow moulded, with an integral handle and a screw-top opening at for screw-threaded connection with a lid. The container caps typically employ standard screw fittings which are removed for filling the dispensers for soap and other liquids.

It is important that the fluids—whether for lubricating, cleaning or production processes—are managed such that only the correct fluids are dispensed and that the fluids are not further decanted by staff, the general public or other miscreants for unauthorised personal use. In the installation of a liquid dispensing system, factors of convenience in ensuring that the dispensers are maintained at a suitable level must be weighed against security of product. In some dispensers, the container is readily removable from the dispenser by any user, so that the entire container could easily be replaced by a "bootleg" container. To avoid this problem, some dispensers are provided with closed, lockable cabinets for enclosing the refill cartridge or container, so as to prevent access by unauthorized persons. But this type of housing is relatively expensive. Furthermore, such prior dispensers have had a relatively complex construction, frequently using a large number of parts, the assembly of which entails substantial labour.

U.S. Pat. No. 4,085,867 teaches of a dispensing container together with a wall mounted dispensing rack for use in bathrooms and the like. As shown in FIG. 1, a dispensing container 10 comprises a main chamber 11 and integrally formed pump chamber 12 beneath the main chamber. The walls of the pump chamber are flexible and may be manually squeezed to dispense liquid in the pump chamber through a valve system. The dispenser container design is such that a plurality of such containers can be conveniently coupled to a track in horizontal, side-by-side relationship for mounting on a bathroom wall. Whilst convenient for bathroom use, secure use is not possible and application is limited to that of placement within a household premises.

US2011259920 teaches of a manually operated liquid dispenser—as shown in FIG. 2*a*—comprising: a liquid container 20 including an uppermost dispenser 21 through which liquid can be discharged from the container in a dispensing position of the dispenser. The container is mounted upon a bracket 22 and is hingedly retained thereto upon a pivotable cage. The liquid container has a refill opening 23, through which the liquid can be introduced when the container is in an inverted refill position, as is shown in FIG. 2*b*, where a refill bottle is shown, with the refill opening lid displaced to allow a nozzle of the refill bottle to refill the liquid container.

Thus known dispenser systems do not necessarily provide security and/or control with convenience and simplicity.

Many "universal" systems relinquish security and stock control and/or are complex to utilize.

Object of the Invention

The present invention seeks to provide a solution to the problems addressed above. The present invention seeks to provide a dispensing system and a container that enables simple checking of fluid levels and simple re-filling thereof. The present invention also seeks to provide a dispensing system that readily adapts to dispensing requirements, which can readily and easily be manufactured, at low cost and which can be retro-fitted to pre-existing liquid supply systems in factories, workshops etc.

Statement of Invention

In accordance with a general aspect of the invention, there is provided a liquid dispensing system comprising a housing, a container for a liquid and a vacuum dispensing tube arrangement; wherein the housing retains the vacuum dispensing tube, provides an enclosure about an aperture defined within a wall of the container and is operably attached to a support surface, wherein the container operably serves to provide a reservoir of liquid; wherein the vacuum dispensing tube arrangement has an outlet pipe; wherein the container is operably engaged with the vacuum dispensing tube arrangement by means of an inlet tube of the vacuum dispensing tube arrangement being inserted into the container through an aperture, whereby liquid can be removed from the container and be dispensed from the outlet pipe; wherein the housing is provided with a securement element, operable in an open state to allow placement of the container within the housing and, in a secured state, to allow engagement of at least one of the securement element and the housing with a handle of the container whereby to ensure secure association of the container and the housing and the inlet tube with respect to the container. The container can be readily fitted to a wall of a building—either inside or outside, be associated with a work bench, machine or washroom sink system, for example. In the case that the system is used in the provision of a liquid supply, possibly including metering and control equipment, for a production facility, workshop or the like, the dispensing system could be easily retro-fitted to pre-existing liquid supply pipes, since standard tubing (typically of 9 mm and 13 mm diameter), although bespoke components can easily be provided, if not be otherwise accommodated using splitters, reducers, adaptors and the like.

The handle of the container can comprise a loop element situated adjacent a cap or aperture arrangement upon an upper part of the container. This allows the housing to partially enclose the container and enables a lower portion of the container to be visible, whereby to enable a simple visual check to be made whereby to determine the level of liquid within the container. In a first alternative, the handle of the container comprises a waist element of the container, about which the securement element can be fastened, conveniently laterally across the enclosure, also ensuring visibility of the container, whereby to allow a level of liquid in the container to be determined.

The securement element can conveniently be fastened to the housing by means of a hinge. This securement element can then be fastened at an end distal to the hinge by means of a detent engagement or by means of a lock and key arrangement, for example. The securement element can be arranged so that it is operable to fasten laterally across the container, conveniently and, in the case that the housing is provided with a cover element and depending elements to each side, the securement element fastens laterally from a first depending element to a second depending element. The securement element can also be arranged to operably fasten vertically from an upper housing cover member, conveniently abutting against a member protruding from the housing, whereby a locking member or clip fastener can be fastened to secure the container in position, with a dispensing or extraction tube in place.

Conveniently, the vacuum dispensing tube arrangement further includes a pump, which can be disposed within the housing, be associated with another housing, positioned adjacent the container housing, for example with a hand-operated pump or be associated with a separate delivery system, across, for example a workshop facility—where it is conveniently a powered pump, whereby to enable dispensing of liquid from the container upon actuation of a switch or under the control of a control system. It is also to be noted that in the event that a systems in accordance with the present invention is retro fitted, overall expense can be reduced by employing pre-existing pump and control systems.

The container is conveniently provided with a self-sealing apertured closure, whereby to simplify the insertion of a dispensing or extraction tube upon installation of a container, the extraction tube conveniently being rigid and of a length such that when placed within the container, the container can be substantially emptied, whereby to reduce waste. The self-sealing apertured closure is preferably provided with a valve, such as a two-flap arrangement (also known as a "duck-bill seal"), or multi-flap variants thereof, the seal member may have a tube feed-in section which is of a general conic shape. The seal, when opened with a tube for dispensing can also provide space for air to pass into the container, since dispensing means typically use vacuum forces to enable passage of fluid, a partial vacuum within the container will reduce the amount of a dispensed quantity. Additionally, a one way valve could be provided to enable pressure compensation to occur e.g. by the provision of air, whereby to prevent vacuum problems arising in any dispensing of the fluid. Additionally, upon removal of the tube, the valve would tend to wipe clean the tube as a container is removed from a dispenser, reducing a tendency for spillage to occur.

The apertured cap can be such that, once fitted, it is irremovable with respect to the container, whereby, inter alia, to prevent use of re-filled containers and avoid problems arising from the potential issue of contamination, arising, for example, to eliminate the miss-use of fluid contents in a simple and cost effective way. Further, this can provide significant advantages in the safe disposal of toxic or otherwise undesirable fluids; since any remaining fluid cannot be removed and the container and closure combination cannot be re-used, the container and closure combination must be disposed of, conveniently through safe/authorised channels. The valve can be provided with an additional one-way valve, to conveniently provide pressure compensation to occur, by permitting air to flow through said additional one-way valve into the container, whereby to prevent vacuum problems arising in any dispensing of the fluid.

Since the container, in use, is supported by a handle or physical attribute of the container feature and retained by the securement member, the container is not obscured by the housing. Thus, especially when the container is manufactured from a transparent or translucent material (or has a transparent/translucent indicator section) it is preferred that the housing does not obscure the lower portion of the container, whereby, for example, the level of the liquid within the container can be easily be determined visually. It is believed that the housing can be presented as a stylish yet functional element, which does not need to be hidden from view, assisting in ready determination of liquid levels. Advantageously, the securement means does not extend below a lower section of the container, whereby a level of the fluid can be indicated or otherwise displayed at all times, whereby the system can provide a ready indication. It will also be appreciated by the use of translucent/transparent containers, that electro-optical sensors could be employed whereby to provide an automated alarm system, noting that the side elements of the housing will need to extend to the alarm level of the liquid.

The dispensing system of the present invention readily lends itself to a lock-and-key security system, whereby change and replacement of a liquid for a particular purpose can only be made possible by authorised persons. Whilst the examples shown in the accompanying Figures relate to the use of two litre containers that are in widespread use in the cleaning industry, the invention can be deployed with far larger containers, such as fifty litre containers.

It will be appreciated that the present invention can conveniently be provided in a range of sizes—from typically 500 ml-5 l or more and is not restricted to any particular size, shape or design. Equally, it will be appreciated that the housing can be associated with external pumps as well as internal pumps, to be used, for example with hand pumps for local application or for disparate dispensation, via taps or otherwise. In the event that separate pumps are employed, then any tubes associated with a delivery of a liquid need to have access through the body of the plastics housing, noting that internal tube carriers can be moulded within a rear portion of the housing.

The housing can conveniently be provided in a range of types of plastics, using injection moulding techniques or otherwise. The housing can be provided with an internal pump—and be operated under manual control or an automatic system or otherwise. The pump can be arranged such that a liquid is dispensed remote form the container or is the liquid is dispensed by means of a tap associated with, for example, the housing. It will be appreciated that the housing and/or the outlet tubes can be colour coded to assist in a differentiation of the liquids contained therein, the housing and the tubes being provided in a range of standard plastics materials, for example, being provide with anti-microbial plastics product protection solutions, being plastics additives such as heparin. Additionally, it will be appreciated that specific antimicrobial plastic additives can assist in protecting product surfaces from the uncontrolled growth of stain and odour causing bacteria. The plastics body may be adorned with various brands and/or designs. In the Figures, the securement element has been designed to produce a seamless upper surface whereby to facilitate cleaning the dispense system as well as producing a much smoother and visually appealing form.

The present invention thus provides a simple to fabricate and use liquid dispensing arrangement, which can enable satisfaction of security, health and safety requirements that are imposed on all types of businesses as well as increasing compliance with rules and regulations that are seen by some as a hindrance to normal business practice.

BRIEF DESCRIPTION OF THE FIGURES

For a better understanding of the present invention, reference will now be made, by way of example only, to the Figures as shown in the accompanying drawing sheets, wherein:—

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific. For the avoidance of doubt, the term closure refers to devices used to close or seal a bottle, jug, jar, tube, can, container, barrel, keg etc. Closures can be a cap, cover, lid, plug, bung, etc.

Referring now to FIGS. 3, 4*a*, 4*b*, 5 & 6, there are shown, respectively, a front view of three dispensing systems in accordance with the present invention; a front view of a single dispensing system, with a container in position and having a securing member in a release position; a perspective view of two dispensing systems, one having a liquid container in place and the other having its securing member in a release position, no container and the vacuum tube in dispense position, and a set of three dispensing containers in perspective view.

Figure 1:
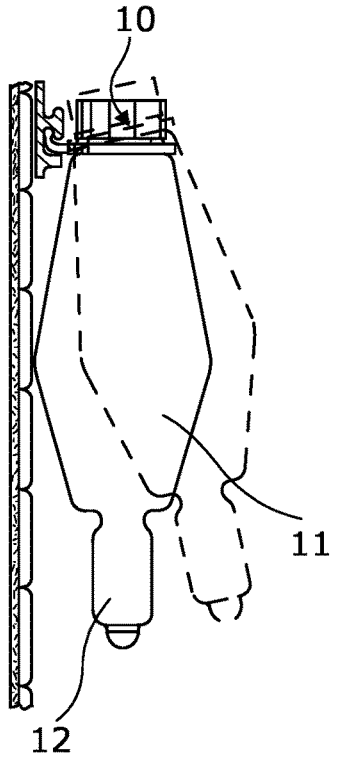
Fig. 1 (Prior Art)
FIG. 1 illustrates a first prior-art dispensing system.
Figure 2A:
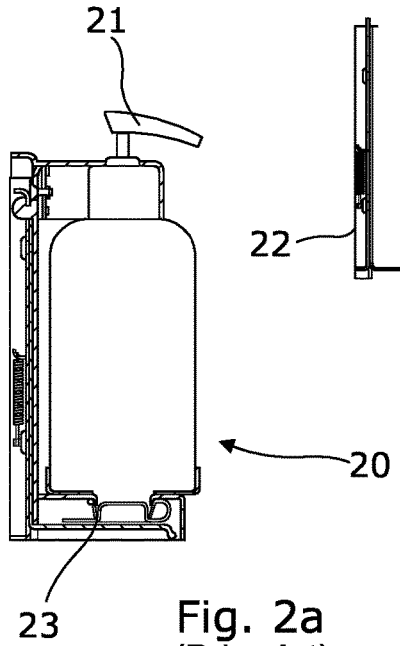
Fig. 2a (Prior Art)
FIGS. 2*a* & 2*b* illustrate a second prior-art dispensing system ready for dispensing and as being re-filled.
Figure 2B:
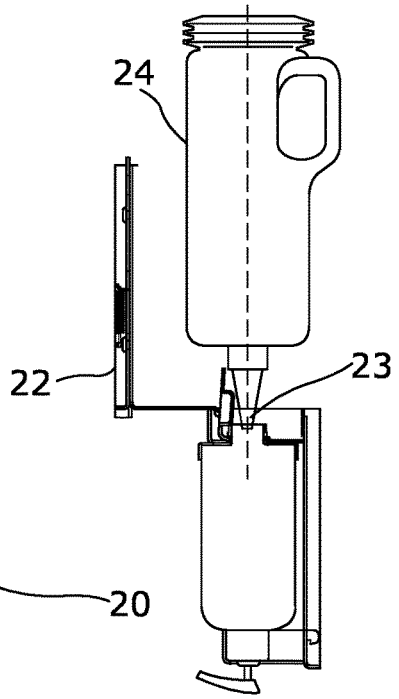
Fig. 2b (Prior Art)
Figure 3:
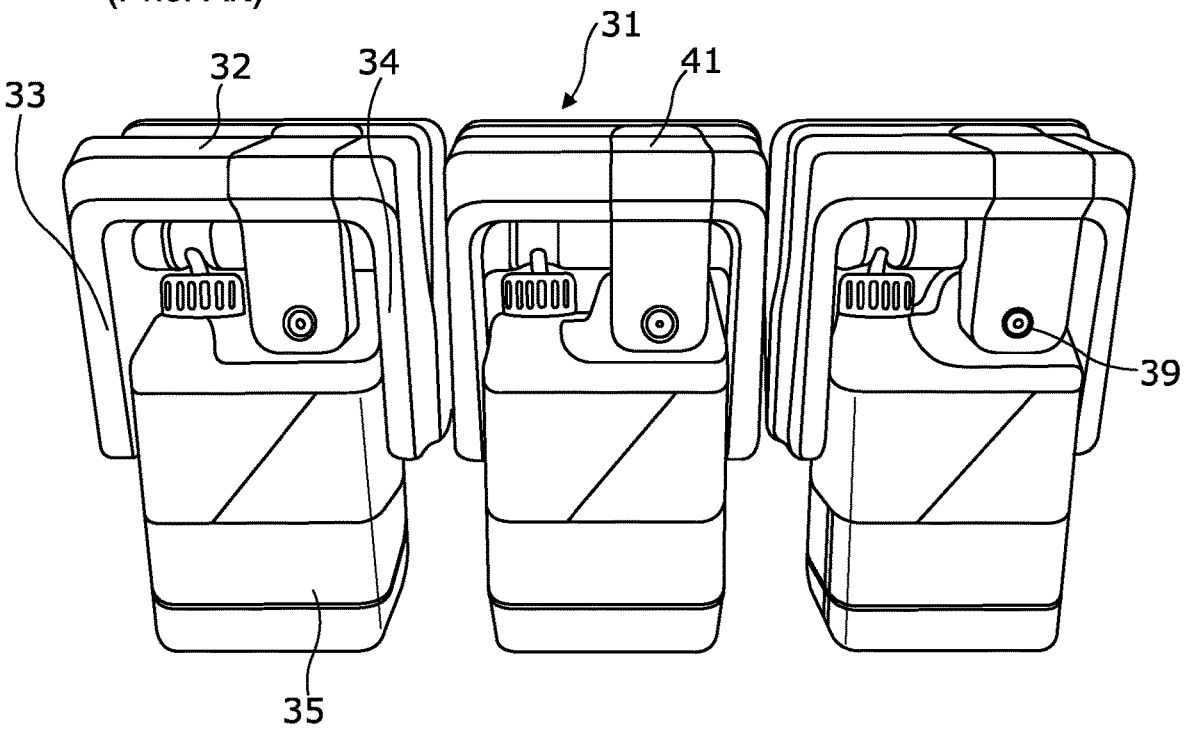
FIG. 3 shows a front view of three adjacently placed container-dispensing units in accordance with the present invention.

With reference to FIG. 3, the dispensing system has three colour coded housings each comprising a body 31 comprising a cover portion 32 and two side sections 33, 34, which depend either side of a container 35 from which liquid is dispensed under vacuum, in use, through a dispensing tube (not shown in this figure). Protrusions on the inside lower portion of the side sections can assist in allowing the bottle to be gripped securely and compensate for the reduction in any 'bulge' as the bottle empties.

Figure 4A:
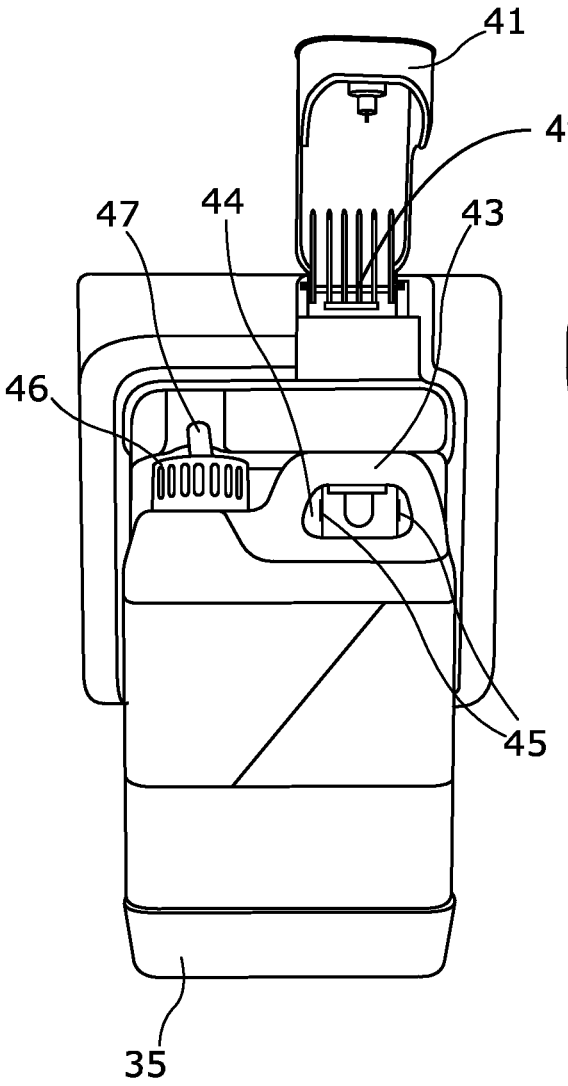
FIGS. 4*a* and 4*b* respectively show a single container-dispensing unit with a securement member in a release position and a secure position.
Figure 4B:
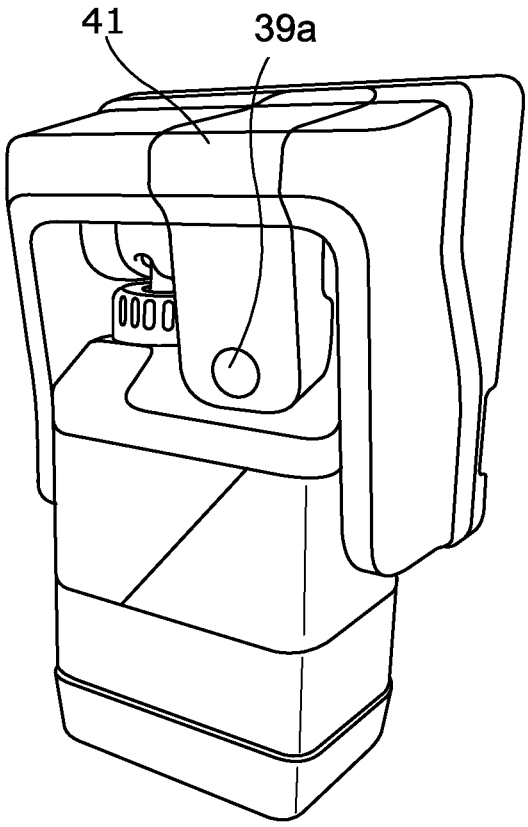

FIG. 4*a* shows a single unit, with the securement member 41 in a raised position attached by a hinge 49. The container 35 has a handle 43 and in this Figure the securing member 41 acts in concert with a member 44 upstanding with respect to body 31, whereby in a secured position—the container 35 is secured with respect to the body 31 of the dispensing system by means of the handle 43. An apertured feature allows the choice of a press-button 39*a* detent clip operable to mechanically secure the securement member 41 to the housing 31. Preferably, upstanding member 44 comprises a separate component to the housing moulding, whereby the upstanding member can be interchanged for different container handles. Two additional holes 45 present on the upstanding member provide points for the hinging arm moulding to clip onto, providing some security when a lock is not fitted. or a more secure feature such as a barrel lock 39 as shown in FIG. 3—to securely fasten the securement member 41. The container is equipped with a cap 46 through which a tube (not shown) can be sealingly engaged, the tube being pivotally mounted about a delivery feed element 47.

Figure 5:
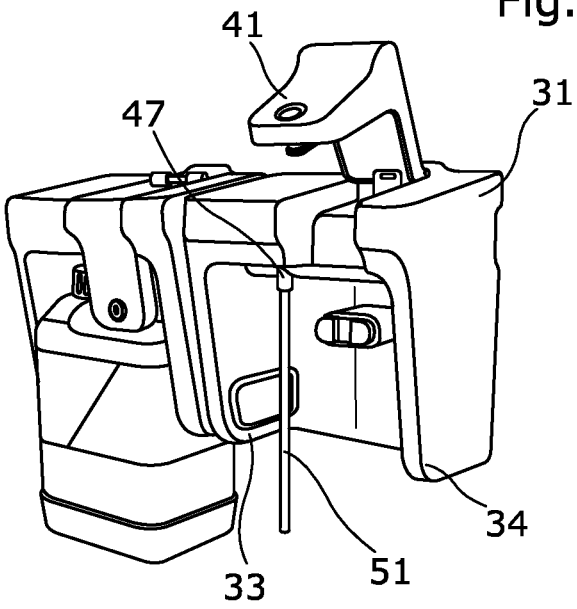
FIG. 5 shows a pair of units in perspective view from one side.

FIG. 5 shows two dispensing systems arranged in a side-by-side arrangement, with the left hand side arrangement including a container, which is secured with the securement member 41 in a lowered position whilst the right hand side arrangement is shown without the container in place, the securement member 41 being in a raised position. Dispensing tube 51 is clearly seen between the two depending side elements of the housing 31. The dispensing tube 51 is conveniently pivotally mounted, by means of pivot feed element 47, which feed element has an inner channel and is mounted for pivoting about a horizontal axis. The pivot part can conveniently be moulded in acetal-type plastics material. The part is held in place by two small pivot seats within the housing mouldings which allow the component to pivot, while a sprung leg returns the part and the stainless steel tube to an upright position by default. It will be appreciated that the tube could be made of different materials, such as a rigid plastics material. The tube can, for example, be integrally moulded with the pivot element, be simply mounted by way of a push-fit tube on the end of the pivot feed, be provided with a detent system such as a bayonet mounting. It will be appreciated that a detent form of fastening will be preferably, to remove a possible likelihood of tube removal, by slippage and/or mishandling. The bayonet form may also permit a simple and reliable change of tube to accommodate a different cap assembly associated with a different container, for example. Equally, the bayonet features could permit the fitment of various types of diameter tube, to permit different rates of flow, taking into account viscosity etc. Equally, the tube could comprise a rigid metal tube.

Conveniently, a one way valve is provided both within the inlet tube but also for the outlet tube from the housing, whereby to prevent, excess dripping when exchanging containers or, for example, to prevent diluents being sucked back to the dispensing system. It will be noted that the propensity of a system to drip will vary, dependent upon, inter alia, the inside diameter of the tube, the viscosity of the liquid and the surface tension arising between the liquid and the tube. Additionally, a flexible tube terminating portion may be provided to assist in removal of liquid in the event that different size containers are employed, so that the flexible tube portion can extend to a lowermost inside surface of the container, irrespective of the actual size of the container.

When changing the container, the tube can pivot upwardly to aid insertion of the tube into the container—and also to permit the handle to be placed about a handle support (although this would not necessarily be an issue, for example, in the event that the securement member included a feature whereby it would engage with a handle arranged upon a top surface of the container). It is also envisaged, in an alternative system, that the tube remains vertically oriented throughout an container exchange operation, that the tube is inserted into an aperture of the container when it is arranged at 90° to the plane of the housing and that once the tube has been fully inserted the container is rotated about the tube axis whereby to allow the handle support to receive the handle of the container.

Figure 6:
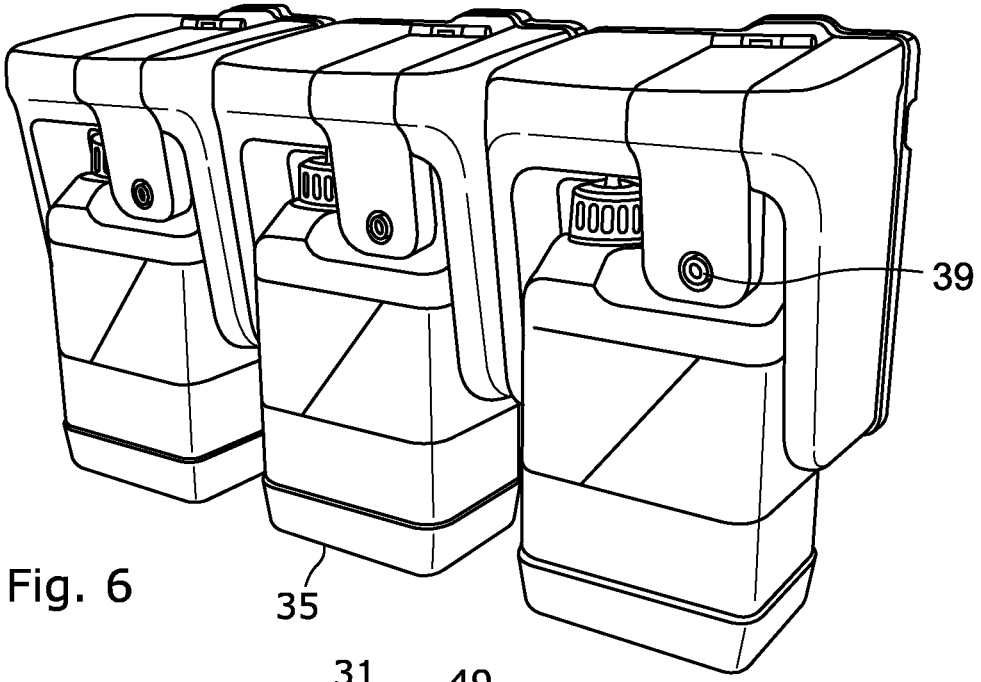
FIG. 6 shows a perspective view of three dispensers coupled together.
Figure 7:
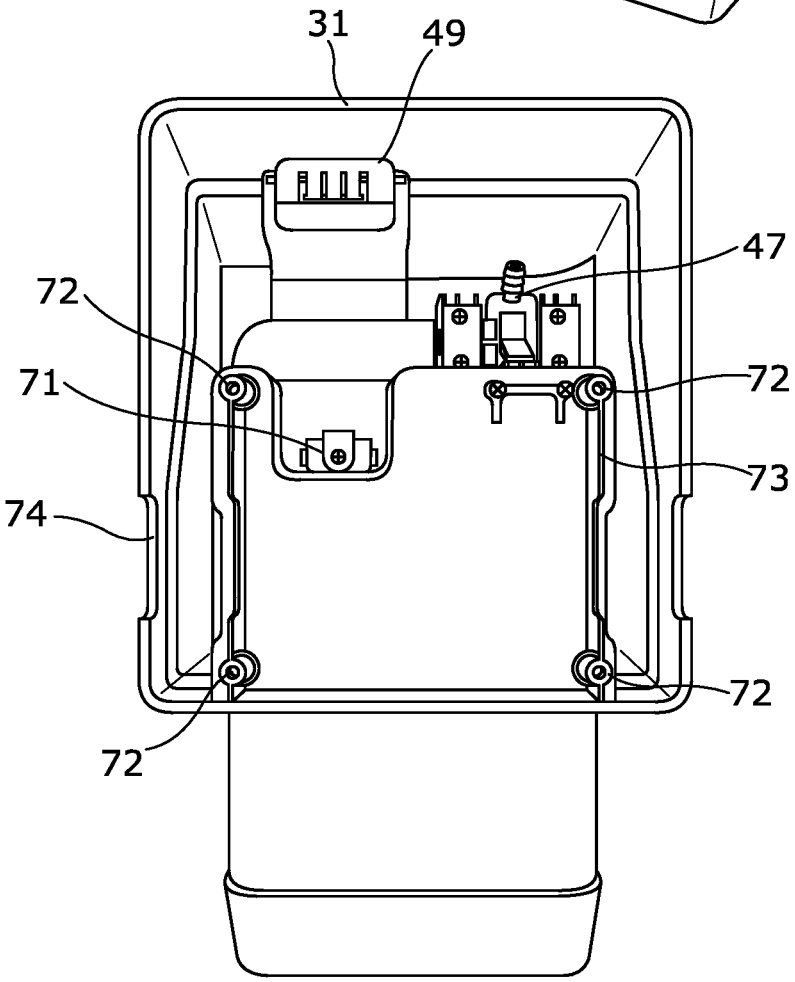
FIG. 7 shows a rear view of a variant of the single container-dispensing unit as shown in FIG. 4.

FIG. 6 shows a set of three containers 35 placed within three housings 31. Barrel lock mechanism 39 is indicated on securement element 41, which is attached to the housing 31 by a hinge 49. FIG. 7 shows a rear view of housing 31, which is conveniently fastened to a wall or other support surface by means of screw-fasteners, through screw boss apertures 72, for example using 4 mm diameter screws. Reference numeral 71 refers to a screw-fastening, whereby an associated screw fastener can locate with a rear face of upstanding member 44, whereby handles associated with different styles of container can be accommodated. In this Figure, there is also indicated an inside section of the pivot feed element 47, which can lead to a pump retained within the housing or to a pump associated with a factory floor, for a number of dispensing units. Rib features 73 are also present on the back of the moulding, to increase rigidity of the moulding. Entry slots 74 are provided within each side element 33, 34, to allow distribution tubing to pass from the pivot feed element 47 to a hand dispenser, valve or otherwise. These slots 74 can be defined by a thin plastics member, as part of the moulding 31, which slots can be cut out by the use of a sharp knife, for example. Such slots can also be provided on the top surface of the moulding 31.

Figure 8A:
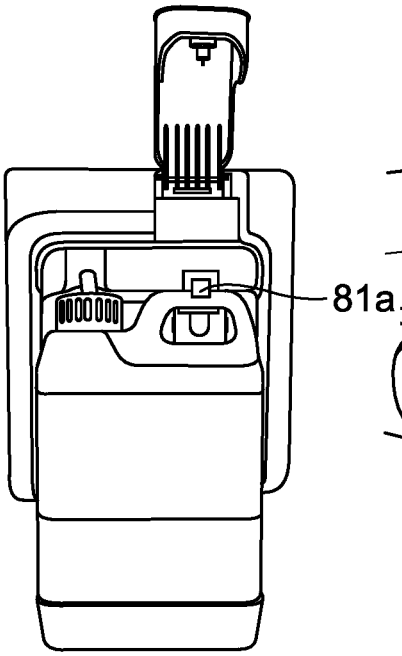
FIGS. 8*a-d* show, respectively, a front face view, a detailed close-up, a rear perspective view of a further embodiment, and an alternate embodiment comprising an alternate latch feature.
Figure 8B:
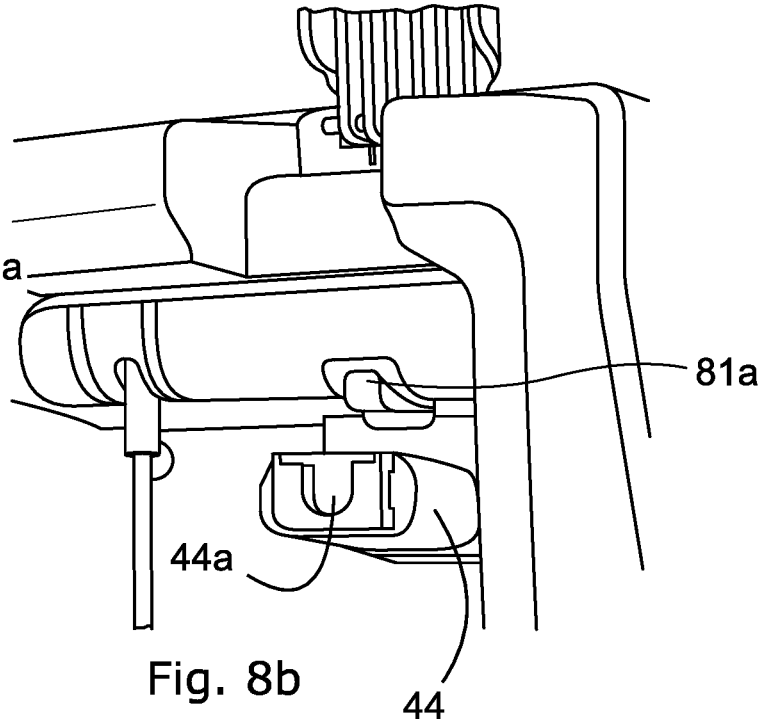
Figure 8C:
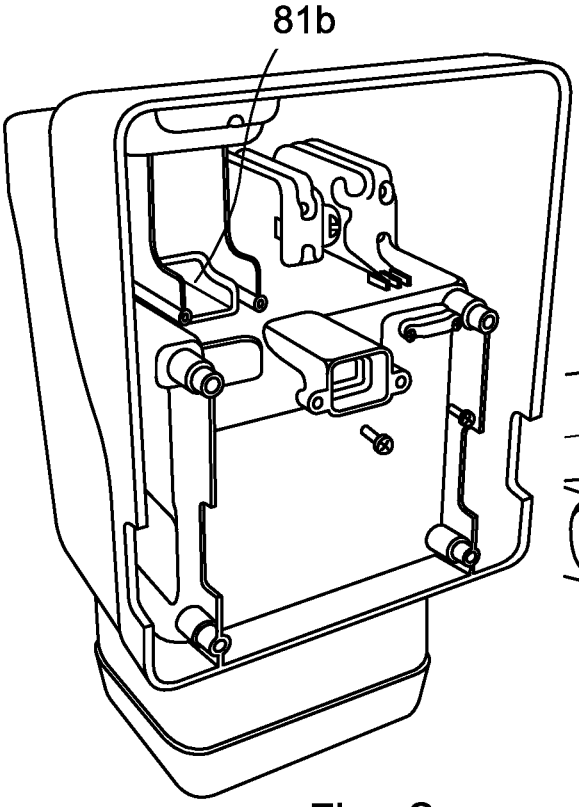
Figure 8D:
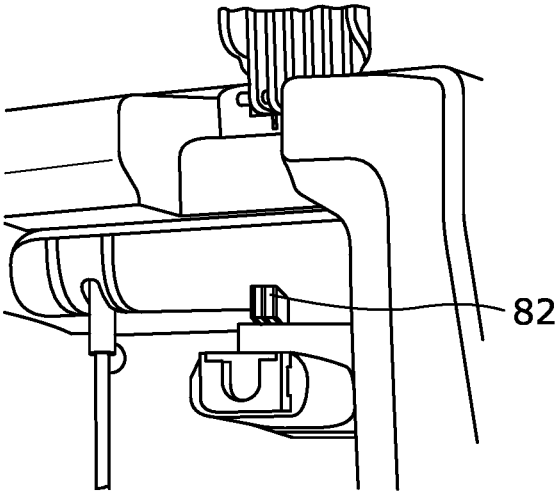

FIGS. 8*a*, 8*b* & 8*c* show, respectively, a front face view, a detail close-up and a rear perspective view of a further embodiment wherein an insert 44 is provided to match an upper handle part of a container, to prevent certain configurations. FIG. 8*d* shows an alternative, wherein an alternate latch feature 82 is provided for the moulding, whereby only one type of handle can be accommodated.

As shall be discussed below, with reference to FIGS. 8*a*-8*d*, the dispensing tube 51 is inserted into the cap 46 of the container whilst the tube extends outwardly, since in this embodiment the handle of the container 43 needs to locate with respect to upstanding member 44. That is to say, the tube 51 is inserted into the container prior to the container being attached to the dispensing system; once the dispensing tube has been inserted, the tube is pivoted about its mounting axis and as the tube becomes vertically oriented, the handle 48 of the container surrounds the upstanding member 44. Once the securement member 41 has engaged the upstanding member 44, then a push-to-release button or a lock and key arrangement can be provided, depending upon the security requirements of the facility. By providing a resilient member, the component can be fabricated so as to return to a vertical orientation by default. The resilient member can be a plastics member inserted or otherwise integrally moulded into the housing 31. Alternatively, steel springs could be provided. A serrated nipple allows the tubing to attach to the back end, which could be stepped to accept two different diameters of tubing, for example 9 mm and 16 mm as commonly used in dispensing systems. In an alternative arrangement, however, the system could be arranged such that the tube is fixed and that the tube is inserted into a container as the container is raised; once the tube has been inserted into its operating position with respect to the container, the securement member can be arranged so as to support the handle of the container; whilst such an arrangement would allow the possibility of the container dropping, this may be of benefit in a single handed removal of the container into a collecting receptacle. The upstanding member 44, if separate, may be attached to the rear of the housing or the front of the housing and is fastened, for example using screw-fastening means, detent means etc.

In the foregoing, the dispensing tube is shown as being inserted into the container, with the tube being inserted through a cap having a valve, for example as disclosed in commonly owned GB2513840. Whilst the cap having an aperture with a valve as disclosed in GB2513840 is irremovable, such a feature is not necessarily required, given that the valve is the feature of importance, especially since the container, when being fitted with the hingedly mounted dispensing tube is oriented such that contents would otherwise be dispensed were it not for the valve enveloping the tube such that no spillage occurs in placement of the container. It will be appreciated, however, that the advantages of the irremovability of the cap is of importance in ensuring that a cross contamination of liquids is less likely to happen e.g. the original label of the container will correspond with the liquid inside; additionally, security of product is important. Accordingly, a standard five litre container 35 having a cap or aperture closure 46 is conveniently employed. An upstanding member (i.e., a handle receiver) 44 is shown which supports the five litre container 35 by suspending it from the handle 43. The upstanding member 44 may have a slot 44*a* for receiving the barrel lock 39 of the securement member 41. A handle clasp 81*a* may be provided to ensure a proper fit of the handle 43 onto the upstanding member 44. A rear view of the handle clasp is shown as 81*b*. In some embodiments, a mating latch 82 for a removable handle guide 81*a* may be provided.

Figure 9A:
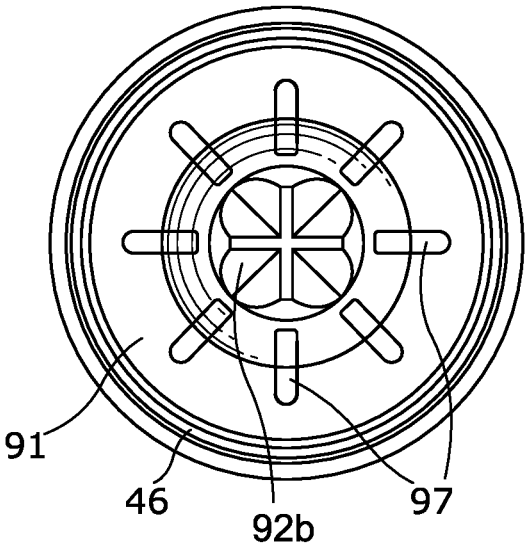
FIGS. 9*a-d* show an embodiment of the closure aspect.
Figure 9B:
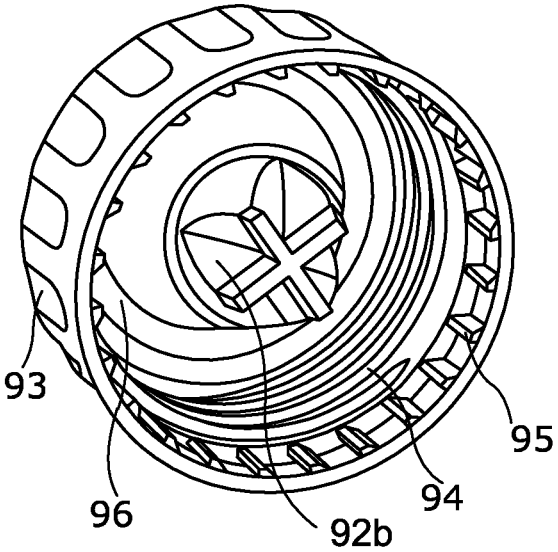

FIG. 9*a* shows a plan view of aperture cap 46, which has a top outside face 91 with a central depression 92*a*; along the outside wall of the apertured closure, there are provided knurled formations 93 which can be utilised to enable the cap to be securely fastened upon first use. The central portion 91 comprises an indented "X"-shaped area, corresponding to an orthogonally arranged duckbill valve. Turning to FIG. 9*b*, apertured closure 46 is shown as having an inside seal member 96 which, in use, abuts a rim of the opening of the container. Whilst the rim of the container is not shown, examples of such are well known, typically comprising a short length of generally circularly cylindrical wall about an aperture to the inside of the container, the outside wall having a screw-thread, which is inter-engageable with an inside wall of the apertured closure. Conveniently, the apertured closure 46 has a locking mechanism 95 whereby once attached by way of the screw-thread fittings with regard to screw-thread 94, removal of the apertured closure is not possible. One-way-detent systems 95—or barbed systems—are widely available for child-proof caps and the same detent release system can be adapted to ensure that no release is possible. A shroud may also depend from the wall of the apertured closure so that it is not possible to insert a tool to remove the cap, or at least not to enable removal and subsequent re-fitting, whereby to enable tampering to be determined. It is also possible to have the apertured closure attached by a push-on, non-releasable fashion as are also widely available.

Figure 9C:
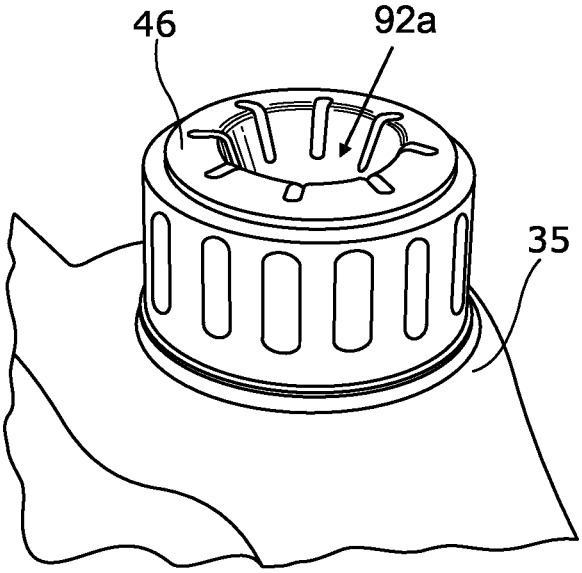

Referring to FIG. 9*c*, there is shown a container 31, operable in a dispenser system in accordance with the present invention. In this case, the container is a standard 2 litre container with the detent teeth—not shown—arranged for use with elastic "squeeze-release" child-proof caps. In contrast with such caps, the present invention provides an apertured closure or cap which does not provide any give arising from any inherent flexibility nor any frangibility, whereby to ensure that once an apertured closure in accordance with the invention has been placed upon the container, it cannot be removed.

Figure 9D:
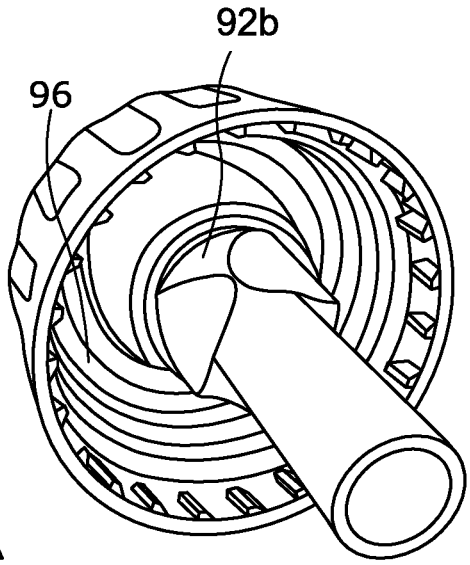

FIG. 9*d* shows a view of the inside of the apertured closure 46: the inside of the central hollow 92*a*—as seen from the outside—extends inwardly of the inside of the apertured closure and comprises an aperture with a resilient seal member 96, shown here in a self-sealed, closed position. A perimeter inside seal member—such as a duckbill member 92*b* (being the inverse of the depression 92*b*) is situated within the apertured closure whereby, in use and upon fastening of the apertured closure with respect to a container, a seal is created which prevents fluid seepage therebetween. The seal of the aperture seal member 92*b* and inside seal member 95 are conveniently made from the same plastics material at the same time in an injection moulding operation. The seal is conveniently manufactured from a thermoplastics rubber such as nitrile butadiene rubber, but compatibility/suitability of such a seal must be determined with reference to the fluid contained within the container. Nitrile butadiene rubber (NBR) actually comprises a family of unsaturated copolymers of 2-propenenitrile and various butadiene monomers (1,2-butadiene and 1,3-butadiene) and the specific physical and chemical properties vary depending on the polymer's composition of nitrile, this form of synthetic rubber being generally resistant to oil, fuel, and other chemicals (the more nitrile within the polymer, the higher the resistance to oils but the lower the flexibility of the material), with a typical usable temperature ranges of −40° C. to 108° C. Neoprene could also be chosen, for example; there are many other types of suitable materials.

Referring back to FIG. 9*a*, the container cap is shown in plan view sand exhibits a spoke-like pattern 97 radiating from the depression area, which comprise apertures defined in the semi-rigid cap member 46; not only does this provide a pattern—which can help identification of particular fluids if supplied in different colours—this also assists in a mechanical bonding of the resilient plastics material to the semi-rigid apertured closure. The outer, semi-rigid lid (i.e. less resilient than the central resilient plastics material can be manufactured from a material such as high density polyethylene (HDPE) or polypropylene, and similar plastics materials. It will be appreciated that other materials, such as brass, aluminium alloys and other metals could also be utilised to fabricate the cap member.

Figure 10A:
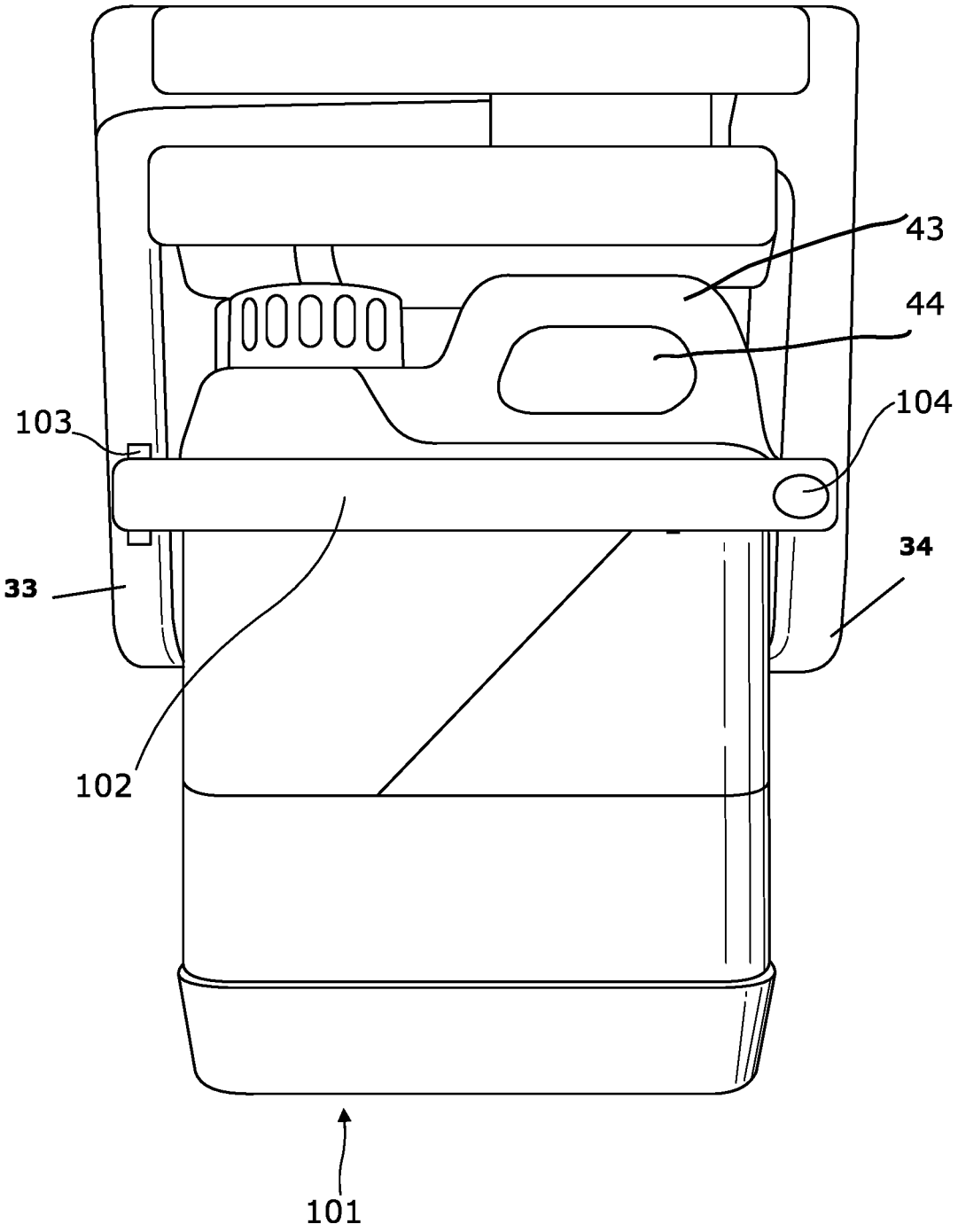
FIGS. 10*a*-10*d* show four alternative housings in accordance with the invention.
Figure 10B:
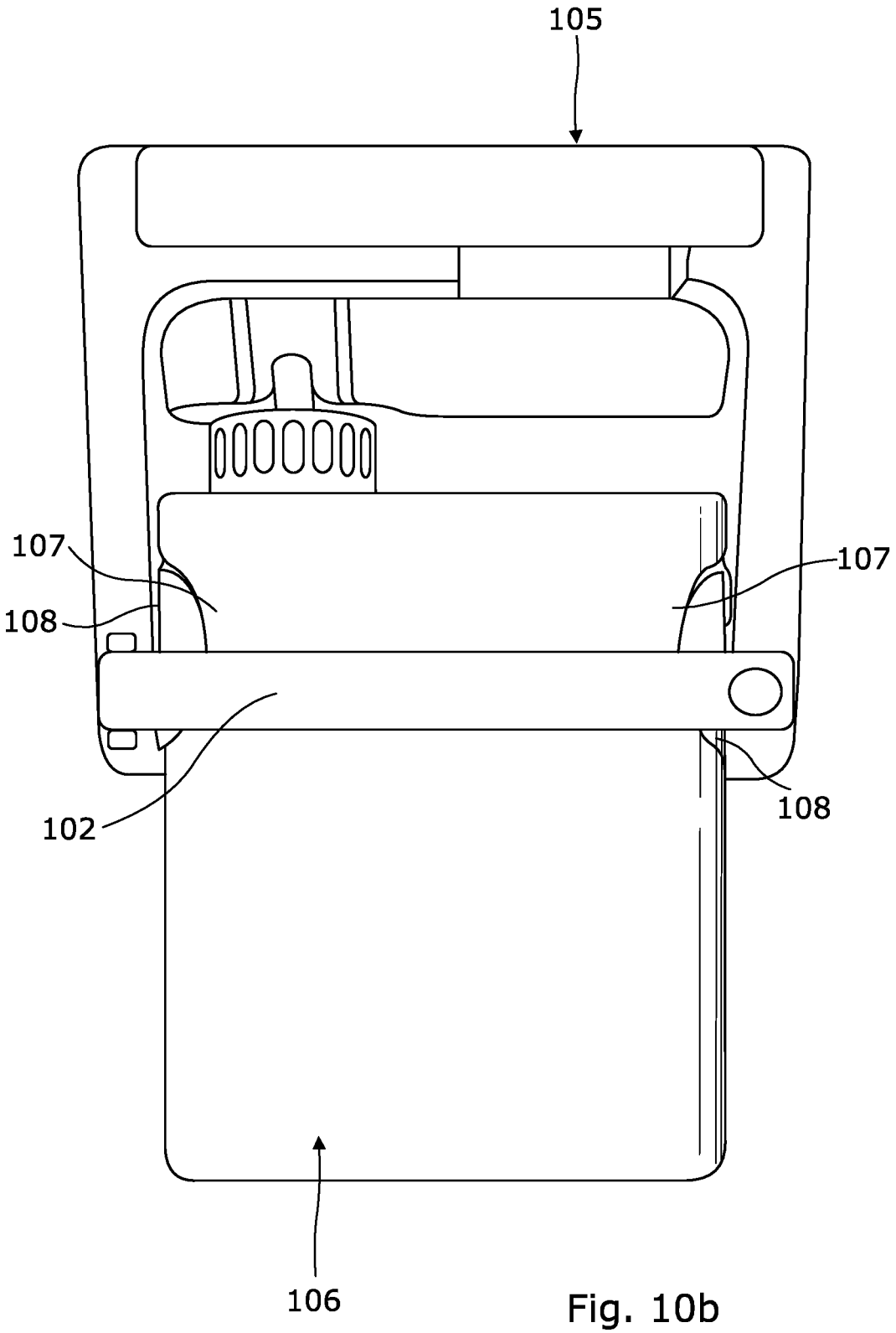

FIG. 10*a* shows an alternative housing 101 with a laterally arranged securement element 102 which is hingedly fastened 103 to a first depending member 33 of the housing and fastened by a push button mechanism 104 or lock mechanism to second depending member 34 of the housing, with the handle of the container 43 being supported by a protruding element 44. FIG. 10*b* shows a still further alternative housing 105, retaining a container 106 having a waist section defined by indentations 107. The housing in addition to the lateral securement element 102 is characterised in having two inwardly extending features 108 either side of the dependent side parts of the housing 33, 34. Thus the handle of the container is defined by the waist section and can provide a secure means of retaining the container in place, subject to the container being sufficiently rigid, as would be known and easily determined by a skilled man. The tube depending from the housing could be arranged centrally, in the event that the neck/aperture of the container was also centrally located with respect to the container as a whole.

Figure 10C:
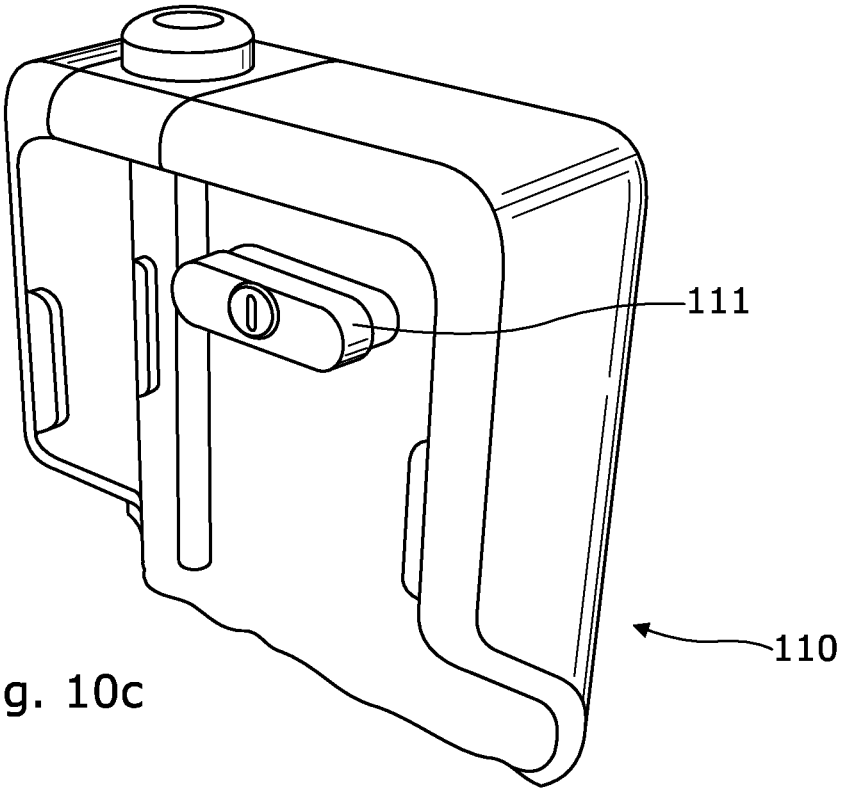
Figure 10D:
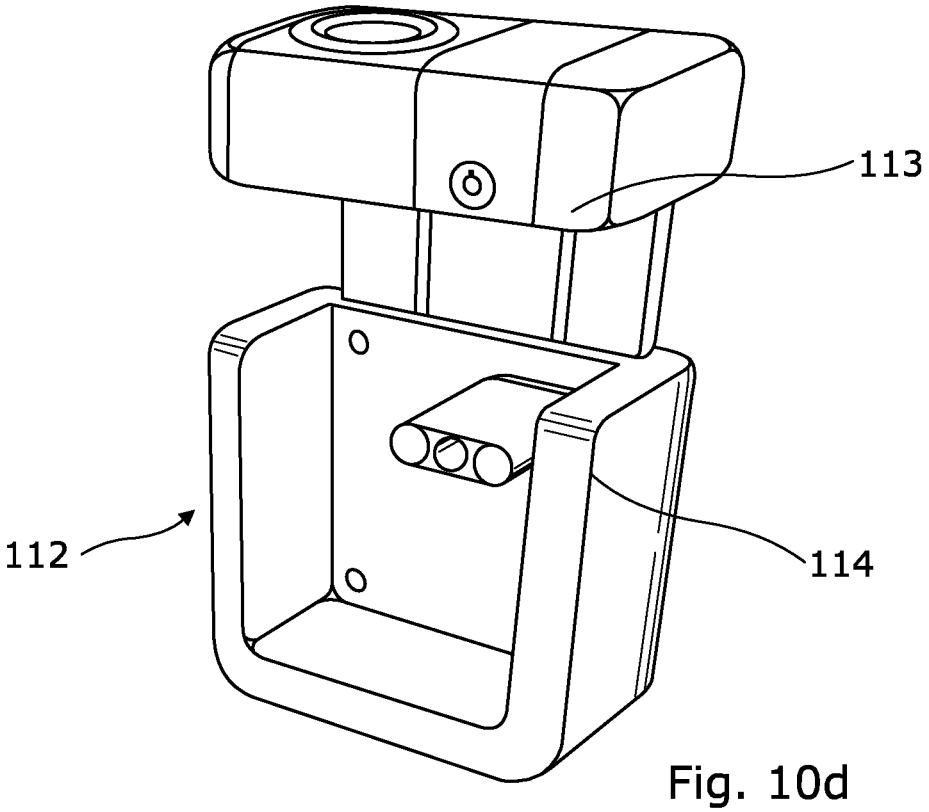

FIG. 10*c* shows a further alternative, wherein there is provided a rotatable member 111 on the upstanding element of the housing 110, that is operably fitted within the handle of a container having a top mounted handle. Upon placement of the container, the rotatable member is rotated to secure the container and any lock (not referenced) operated to securely prevent removal of the container from the housing. FIG. 10*d* shows a still further embodiment, wherein the housing 112 comprises an upper housing part 113 and a lower housing part 114, wherein the parts are movable relative to one another whereby to enable secure placement of the container (not shown), the upper member locking the lower member in place in a closed position, with a key being operable in a lock optionally being provided. It would also be possible in a further embodiment (not shown, but similar to the embodiment shown in FIG. 3) wherein a lower part of the housing provides support for a lower surface of the container, and that a securing element prevents movement of the container, once located within, the securing element enabling the level of the liquid to be simply shown (where the container is transparent or translucent), with the advantages of the container being simply and reliably changed still being realised.

The invention provides a fluid dispensing system which provides a simple arrangement whereby container of operating liquid can be easily be replaced. The operating fluid can be one or more of the following types of liquid: lubricant/chemical supply/cleaning fluid/process fluid/etc. The design allows secure placement (in terms of positioning) and, optionally, secure retention (with the use of locking arrangements appropriate for a specific use). By the use of specific containers for particular applications, the risk of cross contamination between containers and pumping systems can be minimised, especially with the use of colour coding and similar distinguishing systems. This can also assist in stock control, with clearly identifiable products being distributed from a stores department in a timely fashion, using sealed packaging where appropriate.

The present invention thus provides a liquid dispensing arrangement or housing that may be utilized universally with both dispensing and dilution mechanisms, yet remain specific for each installation. The container is conveniently retained by way of a handle or other shape specific feature of the container, to ensure accurate location of the container when placed within the dispenser. The liquid dispensing arrangement can be arranged with either an internal pump—as commonly used for the cleaning of hands, where a dispensing outlet is part of the housing or a complementary shaped module, for example—or an external dispensing pump, for use in a disparate dispensing system. By the use of the hinged securement element, replacement of a container for dispensing through the liquid can easily be accomplished, with a vertical release or hinged release system to enable satisfaction of health and safety requirements that are imposed on all types of businesses and increases compliance.

Importantly, the use of a design which does not totally envelope the container permits simple checks of a liquid level to be determined and easily confirmed, as part of, for example a regular ISO-inspection or regular check of a premises—as is typically performed in manufacturing bases etc. Whilst compliance is always difficult to monitor and assess, by the provision of a dispensing system with an easily determinable level and a replenishment procedure that is easy to accomplish with little or no mess and provides easy to check levels of liquid with respect to containers, which can easily be replaced. The advantages in maintaining a premises compliant with regard to the numerous health and safety regulations are significant. Additionally, the secure retention of the liquid containers by the use of a handle of the container or waist or other characteristic shape of the container to ensure correct replacement of the liquid container, noting that in the event that a dispensing pipe which is not positioned correctly within a liquid container may prevent pick-up through blockage of the inlet to the tube or allow kinking of the tube (in the event that it is flexible) the tube, and possibly preventing maximal use to be made from the container since the lick-up tube is not positioned at is ideal lowermost position.

What is claimed:

1. A liquid dispensing system comprising a housing, a container for a liquid and a vacuum dispensing tube arrangement;

wherein the housing retains the vacuum dispensing tube, provides an enclosure about an aperture defined within a wall of the container and is operably attached to a support surface;

wherein the container operably serves to provide a reservoir of liquid; wherein the vacuum dispensing tube arrangement has an inlet tube and an outlet tube;

wherein the inlet tube of the vacuum dispensing tube arrangement is operably arranged within the container through the aperture, whereby liquid can be removed from the container and be dispensed from the outlet tube;

wherein the housing is provided with a securement element, operable in an open state to allow placement of the container within the housing and, in a secured state, to allow engagement of at least one of the securement element and the housing with a handle of the container whereby to ensure secure association of the container and the housing and the inlet tube with respect to the container; and wherein the housing is provided with a cover element and depending elements to each side, whereby to define a receiving area for the container and wherein the securement element is operably arranged to depend vertically from the cover element.

2. The system according to claim 1, wherein the handle of the container comprises a loop element situated adjacent a cap or aperture arrangement upon an upper part of the container.

3. The system according to claim 1, wherein the securement element is fastened to the housing by means of a hinge.

4. The system according to claim 1, wherein the securement element is fastened to the housing by means of a detent engagement.

5. The system according to claim 1, wherein the securement element is fastened to the housing by means of a barrel lock.

6. The system according to claim 1, wherein the securement element is operably arranged about the housing fastened to the housing by means of a hinge.

7. The system according to claim 1, wherein the securement element is operably arranged to fasten vertically across the container.

8. The system according to claim 1, wherein the container is provided with a self-sealing apertured closure.

9. The system according to claim 8, wherein the self-sealing apertured closure is provided with a valve, which valve is a duck-bill valve and comprises a two-, three- or multi-flap valve.

10. The system according to claim 8, wherein the container and closure are fastened by co-operating detent means.

11. The system according to claim 9, wherein the valve is provided with an additional one-way valve, to enable pressure compensation to occur, by permitting air to flow through said additional one-way valve into the container, whereby to prevent vacuum problems arising in any dispensing of the fluid, in the event that the one-way valve member of the aperture of the closure is airtight in both directions with respect to the extraction tube.

* * * * *